US011655773B2

(12) United States Patent
Nose et al.

(10) Patent No.: US 11,655,773 B2
(45) Date of Patent: May 23, 2023

(54) CONTROL DEVICE AND CONTROL METHOD FOR INTERNAL COMBUSTION ENGINE

(71) Applicant: TOYOTA JIDOSHA KABUSHIKI KAISHA, Aichi-ken (JP)

(72) Inventors: Yuki Nose, Nagoya (JP); Yuto Ikeda, Okazaki (JP); Takanobu Gotoh, Obu (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 17/540,118

(22) Filed: Dec. 1, 2021

(65) Prior Publication Data

US 2022/0268230 A1 Aug. 25, 2022

(30) Foreign Application Priority Data

Feb. 24, 2021 (JP) ..... JP2021-027700

(51) Int. Cl.
*F02D 41/14* (2006.01)
*F02D 41/00* (2006.01)
*F02D 41/02* (2006.01)

(52) U.S. Cl.
CPC ..... *F02D 41/1475* (2013.01); *F02D 41/0085* (2013.01); *F02D 41/0087* (2013.01); (Continued)

(58) Field of Classification Search
CPC .... F02D 41/00; F02D 41/008; F02D 41/0085; F02D 41/0087; F02D 41/024; F02D 41/0295; F02D 41/14; F02D 41/1454; F02D 41/1475; F02D 2200/0802; F02D 2200/0814
See application file for complete search history.

(56) References Cited

U.S. PATENT DOCUMENTS 9,212,585 B2 * 12/2015 Mori ..... F01N 3/2892
11,325,579 B2 * 5/2022 Nose ..... F02D 41/042
(Continued)

FOREIGN PATENT DOCUMENTS

JP 201510489 A 1/2015

*Primary Examiner* — John Kwon
*Assistant Examiner* — Johnny H Hoang
(74) *Attorney, Agent, or Firm* — Hauptman Ham, LLP

(57) ABSTRACT

A control device and a control method for a multi-cylinder internal combustion engine including a post-processing device are provided. The control device includes an electronic control unit executing a temperature raising process of raising the temperature of the post-processing device and a recovery-time process. The temperature raising process includes a stopping process and a rich process. In the stopping process, supply of fuel to several of cylinders is stopped. In the rich process, the air-fuel ratio of an air-fuel mixture for different ones of the cylinders other than the several cylinders is made lower than the stoichiometric air-fuel ratio. In the recovery-time process, the concentration of unburned fuel in exhaust gas discharged to the exhaust passage is made higher than an equivalent concentration, when the temperature raising process is stopped. The equivalent concentration is the concentration of unburned fuel being just enough to react with oxygen in the exhaust gas.

13 Claims, 6 Drawing Sheets

(52) U.S. Cl.
CPC ..... *F02D 41/024* (2013.01); *F02D 41/0295* (2013.01); *F02D 41/1454* (2013.01); *F02D 2200/0802* (2013.01); *F02D 2200/0814* (2013.01)

(56) References Cited

U.S. PATENT DOCUMENTS

| | | | | |
|---|---|---|---|---|
| 2002/0050135 | A1* | 5/2002 | Manaka | F02D 41/405 60/285 |
| 2011/0289904 | A1 | 12/2011 | Miyashita | |
| 2013/0144510 | A1* | 6/2013 | Iwazaki | F02D 41/0255 701/104 |
| 2015/0322878 | A1* | 11/2015 | Okazaki | F01N 3/20 60/285 |
| 2017/0101953 | A1* | 4/2017 | Takada | F02D 41/3005 |
| 2018/0252177 | A1* | 9/2018 | Myojo | F02D 41/0245 |
| 2018/0283304 | A1* | 10/2018 | Yoda | F02D 41/1446 |
| 2019/0024556 | A1* | 1/2019 | Nose | F02D 41/0085 |
| 2019/0024603 | A1* | 1/2019 | Myojo | F02D 41/0032 |
| 2019/0195115 | A1* | 6/2019 | Paukner | F01N 11/00 |
| 2020/0271067 | A1* | 8/2020 | Lee | B01D 53/945 |

* cited by examiner

CONTROL DEVICE AND CONTROL METHOD FOR INTERNAL COMBUSTION ENGINE

CROSS-REFERENCE TO RELATED APPLICATION

This application claims priority to Japanese Patent Application No. 2021-027700 filed on Feb. 24, 2021, incorporated herein by reference in its entirety.

BACKGROUND

1. Technical Field

The present disclosure relates to a control device and a control method for an internal combustion engine.

2. Description of Related Art

A so-called fuel cut process, in which supply of fuel to an internal combustion engine is stopped when a vehicle is decelerated etc., is well known. When the fuel cut process is executed, a catalyst provided in an exhaust system of the internal combustion engine stores a large amount of oxygen, and thus the NOx reduction capability of the catalyst is lowered when the fuel cut process is stopped.

Thus, it has conventionally been proposed to make the air-fuel ratio of an air-fuel mixture richer than the stoichiometric air-fuel ratio when the fuel cut process is stopped, as described in Japanese Unexamined Patent Application Publication No. 2015-10489 (JP 2015-10489 A).

SUMMARY

In view of the issue discussed above, the inventor considered executing a process of reproducing a post-processing device when the axial torque of the internal combustion engine was not zero. Particularly, the inventor considered, as the reproduction process, a temperature raising process in which supply of fuel to only some cylinders was stopped and the air-fuel ratio for the remaining cylinders was made richer than the stoichiometric air-fuel ratio to supply unburned fuel and oxygen into exhaust gas. The inventor has found that the capability of the catalyst to reduce NOx is lowered also when the temperature raising process is stopped. Thus, there are provided a control device and a control method for an internal combustion engine that can suppress a reduction in the capability of the catalyst to reduce NOx as the temperature raising process is stopped.

A first aspect of the present disclosure relates to a control device applied to a multi-cylinder internal combustion engine that includes a post-processing device that includes a catalyst having an oxygen storage capability and provided in an exhaust passage of the internal combustion engine. The control device includes an electronic control unit configured to execute a temperature raising process of raising a temperature of the post-processing device and a recovery-time process. The temperature raising process includes a stopping process and a rich process. The stopping process is a process in which supply of fuel to several of a plurality of cylinders is stopped. The rich process is a process in which an air-fuel ratio of an air-fuel mixture for different ones of the cylinders other than the several of the cylinders is made lower than a stoichiometric air-fuel ratio. The recovery-time process is a process in which, when the temperature raising process is stopped, a concentration of unburned fuel in exhaust gas discharged to the exhaust passage is made higher than an equivalent concentration. The equivalent concentration is a concentration of unburned fuel that is just enough to react with oxygen in the exhaust gas.

When the temperature raising process is executed, the stopping process is executed, and thus a large amount of oxygen occasionally flows into the catalyst compared to when the stopping process is not executed. Then, the amount of oxygen stored in the catalyst may be large compared to when the temperature raising process is not executed, even if a large amount of unburned fuel flows into the catalyst through the rich process compared to when the rich process is not executed. In that case, the capability of the catalyst to reduce NOx may be lowered after the temperature raising process is stopped. Thus, with the control device for an internal combustion engine according to the first aspect, the recovery-time process is executed when the temperature raising process is stopped. Consequently, the catalyst is supplied with a larger amount of unburned fuel than an amount of unburned fuel that is just enough to react with oxygen in the exhaust gas, and thus the amount of oxygen stored in the catalyst can be decreased immediately. Therefore, it is possible to suppress a reduction in the NOx reduction rate along with the temperature raising process being stopped.

In the control device for an internal combustion engine according to the first aspect, the rich process may be a process in which the air-fuel ratio of the air-fuel mixture in the different cylinders is changed to be equal to or less than an upper limit air-fuel ratio and equal to or more than a lower limit air-fuel ratio in accordance with the temperature of the post-processing device. The recovery-time process may include a process of setting an air-fuel ratio for at least one of the cylinders to a specific post-stop air-fuel ratio, the specific post-stop air-fuel ratio being higher than the lower limit air-fuel ratio and lower than the stoichiometric air-fuel ratio.

When the temperature raising process includes the rich process, the NOx reduction capability is high compared to when the temperature raising process does not include the rich process, although the amount of oxygen stored in the catalyst may be large when the temperature raising process is executed compared to when the temperature raising process is not executed. Therefore, the fuel consumption rate may be unnecessarily high when the specific post-stop air-fuel ratio is excessively rich in the recovery-time process. Thus, with the control device for an internal combustion engine configured as described above, a rise in the fuel consumption rate can be suppressed by making the specific post-stop air-fuel ratio higher than the lower limit air-fuel ratio.

In the control device for an internal combustion engine according to the first aspect, the rich process may be a process in which the air-fuel ratio of the air-fuel mixture in the different cylinders is changed to be equal to or less than an upper limit air-fuel ratio and equal to or more than a lower limit air-fuel ratio in accordance with the temperature of the post-processing device. The recovery-time process may include a process of setting an air-fuel ratio for at least one of the cylinders to a specific post-stop air-fuel ratio. The specific post-stop air-fuel ratio may be lower than the upper limit air-fuel ratio.

When the amount of oxygen stored in the catalyst is increased by executing the temperature raising process, the NOx reduction rate may be lowered when the air-fuel ratio of the air-fuel mixture is not made rich to a certain degree as the temperature raising process is stopped. It is desirable that this degree should be larger than the minimum degree of richness for maintaining the temperature of the post-processing device to a target value. Thus, with the control device for an internal combustion engine configured as described above, it is possible to suitably suppress a reduction in the NOx reduction rate along with the temperature raising process being stopped, by making the specific post-stop air-fuel ratio lower than the upper limit air-fuel ratio.

In the control device for an internal combustion engine according to the first aspect, the electronic control unit may be further configured to execute a feedback process and a switching process. The feedback process may be a process in which a detected value of an air-fuel sensor provided upstream of the post-processing device is controlled to a target value through feedback control when the temperature raising process is not executed. The switching process may be a process in which the target value is caused to transition from one of two values including a feedback rich air-fuel ratio and a feedback lean air-fuel ratio to the other and vice versa alternately when the temperature raising process is not executed, the feedback rich air-fuel ratio being lower than the stoichiometric air-fuel ratio and the feedback lean air-fuel ratio being higher than the stoichiometric air-fuel ratio. The recovery-time process may include a process of setting an air-fuel ratio for at least one of the cylinders to a specific post-stop air-fuel ratio. The specific post-stop air-fuel ratio may be lower than the feedback rich air-fuel ratio.

With the configuration described above, the amount of oxygen stored in the catalyst can be controlled to an appropriate amount through the switching process. It tends to be difficult to control the oxygen storage amount when the difference between the feedback rich air-fuel ratio and the stoichiometric air-fuel ratio is made large. Therefore, the feedback rich air-fuel ratio tends to be set to such a value that the difference between the stoichiometric air-fuel ratio and the feedback rich air-fuel ratio is small. Therefore, when the specific post-stop air-fuel ratio is set to about the feedback lean air-fuel ratio, oxygen in the catalyst cannot be decreased immediately as the temperature raising process is stopped, and the NOx reduction rate may be lowered. Thus, with the control device for an internal combustion engine configured as described above, it is possible to immediately decrease oxygen in the catalyst as the temperature raising process is stopped, by making the specific post-stop air-fuel ratio lower than the feedback rich air-fuel ratio.

In the control device for an internal combustion engine configured as described above, the recovery-time process may be a process of setting an air-fuel ratio of an air-fuel mixture in all of the cylinders to the specific post-stop air-fuel ratio.

With the control device for an internal combustion engine configured as described above, it is possible to immediately decrease oxygen in the catalyst as the temperature raising process is stopped, by setting the air-fuel ratio of the air-fuel mixture in all of the cylinders to the specific post-stop air-fuel ratio as the temperature raising process is stopped, compared to when the air-fuel ratio for only some of the cylinders is set to the specific post-stop air-fuel ratio.

In the control device for an internal combustion engine according to the first aspect, the electronic control unit may be further configured to execute an all-cylinder fuel cut process. The all-cylinder fuel cut process may be a process in which supply of fuel in all of the cylinders of the multi-cylinder internal combustion engine is stopped. The recovery-time process may include a process of setting an air-fuel ratio of an air-fuel mixture in each of the cylinders to a post-all-stop air-fuel ratio that is lower than a specific post-stop air-fuel ratio after the all-cylinder fuel cut process is stopped. The specific post-stop air-fuel ratio may be an air-fuel ratio of an air-fuel mixture in the cylinders after the temperature raising process is stopped, the specific post-stop air-fuel ratio being lower than the stoichiometric air-fuel ratio.

When the state of the catalyst at the time immediately after the temperature raising process is stopped is compared with the state of the catalyst at the time immediately after the all-cylinder fuel cut process is stopped, the amount of fuel that is necessary to suppress a reduction in the NOx reduction rate tends to be small in the former state. When the post-all-stop air-fuel ratio and the specific post-stop air-fuel ratio are set to be equal to each other in spite of the tendency described above, the fuel consumption rate may be unnecessarily lowered. Thus, with the control device for an internal combustion engine configured as described above, it is possible to suppress both a reduction in the NOx reduction rate and an increase in the fuel consumption rate, by making the specific post-stop air-fuel rate higher than the post-all-stop air-fuel ratio.

In the control device for an internal combustion engine according to the first aspect, the electronic control unit may be further configured to execute a storage amount calculation process. The storage amount calculation process may be a process in which an oxygen storage amount that is an amount of oxygen stored in the catalyst is calculated using, as an input, an intake air amount variable that is a variable that indicates an amount of air taken into the internal combustion engine. The recovery-time process may include a process of setting an air-fuel ratio for at least one of the cylinders to a specific post-stop air-fuel ratio. The recovery-time process may include a change process in which the specific post-stop air-fuel ratio is increased stepwise as the oxygen storage amount is decreased.

When a large amount of fuel flows into the catalyst when the oxygen storage amount is small, a part of the fuel may flow out downstream of the catalyst, even if there exists an amount of oxygen that is just enough to react with the fuel. Thus, with the control device for an internal combustion engine configured as described above, the specific post-stop air-fuel ratio is increased stepwise as the oxygen storage amount is decreased. Consequently, it is possible to quickly resolve a state in which the oxygen storage amount is large and the NOx reduction rate tends to be lowered, and suppress fuel flowing out downstream of the catalyst, at the same time.

In the control device for an internal combustion engine according to the first aspect, the recovery-time process may include a forced rich process. The change process may include a process in which the specific post-stop air-fuel ratio is changed from a first rich air-fuel ratio to a second rich air-fuel ratio when a transition is made from a state in which the oxygen storage amount is larger than a prescribed value to a state in which the oxygen storage amount is equal to or less than the prescribed value. The first rich air-fuel ratio may be lower than the second rich air-fuel ratio. The forced rich process may be a process in which the specific post-stop air-fuel ratio is set to the first rich air-fuel ratio for a predetermined period since the temperature raising process is stopped, even when the oxygen storage amount is equal to or less than the prescribed value.

With the configuration described above, it is possible to suppress fuel flowing out downstream of the catalyst, by changing the specific post-stop air-fuel ratio to the second rich air-fuel ratio when a transition is made to a state in which the oxygen storage amount is equal to or less than the prescribed value. The inventor has found, however, that the NOx reduction rate may be lowered when the specific post-stop air-fuel ratio is set to the second rich air-fuel ratio, even if the calculated oxygen storage amount is equal to or less than the prescribed value, after the temperature raising process is stopped. Thus, with the control device for an internal combustion engine configured as described above, the specific post-stop air-fuel ratio is temporarily set to the first rich air-fuel ratio, also when the oxygen storage amount at the time when the temperature raising process is stopped is equal to or less than the prescribed value, by providing the forced rich process. Consequently, a reduction in the NOx reduction rate can be suppressed.

A second aspect of the present disclosure relates to a control method applied to a multi-cylinder internal combustion engine that includes a post-processing device that includes a catalyst having an oxygen storage capability and provided in an exhaust passage. The control method includes executing a temperature raising process of raising a temperature of the post-processing device and executing a recovery-time process. The temperature raising process includes a stopping process and a rich process. The stopping process is a process in which supply of fuel to several of a plurality of cylinders is stopped. The rich process is a process in which an air-fuel ratio of an air-fuel mixture for different ones of the cylinders other than the several of the cylinders is made lower than a stoichiometric air-fuel ratio. The recovery-time process is a process in which, when the temperature raising process is stopped, a concentration of unburned fuel in exhaust gas discharged to the exhaust passage is made higher than an equivalent concentration. The equivalent concentration is a concentration of unburned fuel that is just enough to react with oxygen in the exhaust gas.

With the control method for an internal combustion engine according to the second aspect, the recovery-time process is executed when the temperature raising process is stopped. Consequently, the catalyst is supplied with a larger amount of unburned fuel than an amount of unburned fuel that is just enough to react with oxygen in the exhaust gas, and thus the amount of oxygen stored in the catalyst can be decreased immediately. Therefore, it is possible to suppress a reduction in the NOx reduction rate along with the temperature raising process being stopped.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
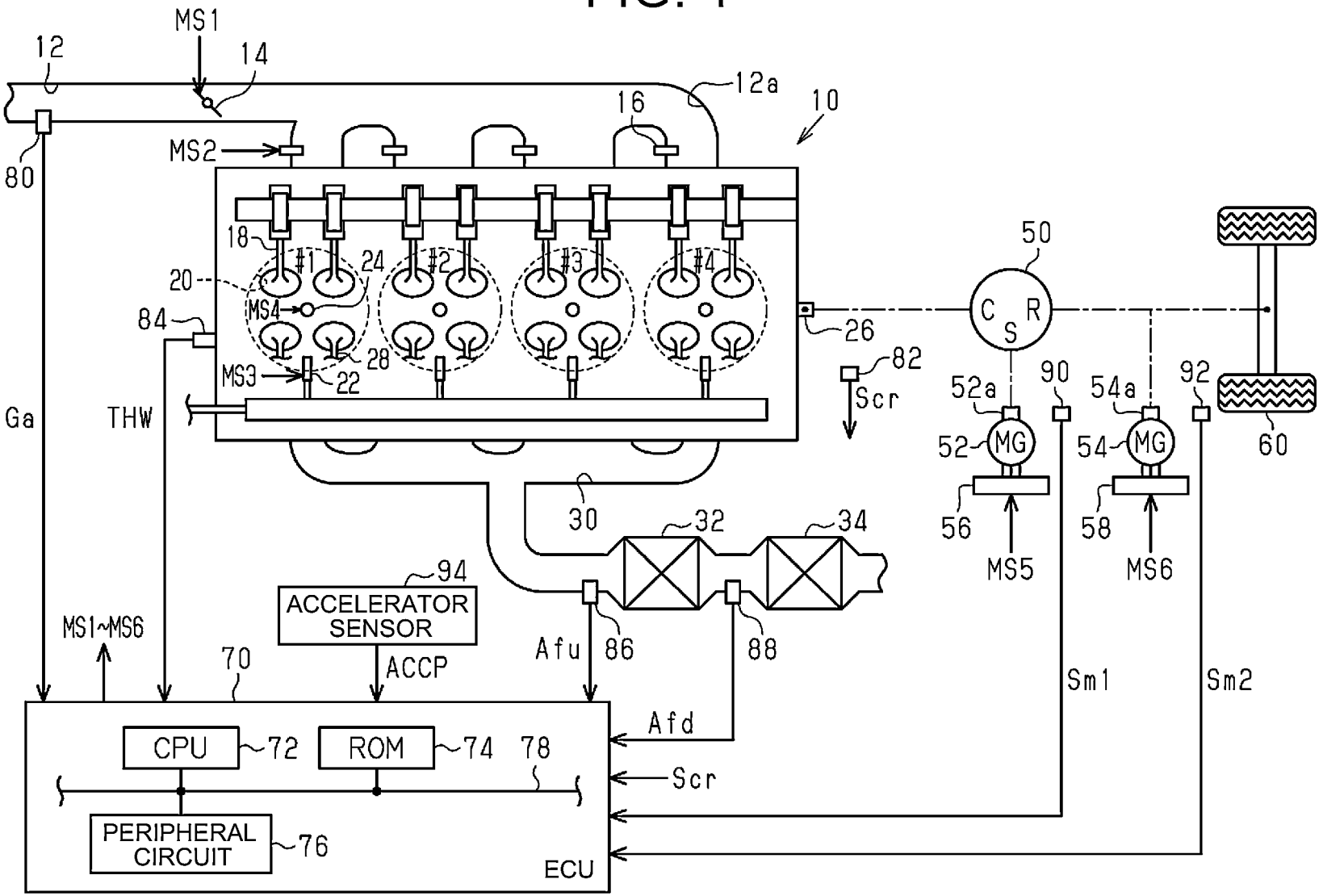
FIG. 1 illustrates the configuration of a control device for an internal combustion engine and a drive system of a vehicle according to an embodiment of the present disclosure.

An embodiment will be described below with reference to the drawings. As illustrated in FIG. 1, an internal combustion engine 10 includes four cylinders #1 to #4. An intake passage 12 of the internal combustion engine 10 is provided with a throttle valve 14. An intake port 12*a*, which is a downstream portion of the intake passage 12, is provided with a port injection valve 16 that injects fuel into the intake port 12*a*. Air taken into the intake passage 12 and fuel injected from the port injection valve 16 flow into a combustion chamber 20 as an intake valve 18 is opened. Fuel is injected into the combustion chamber 20 from an in-cylinder injection valve 22. A mixture of air and fuel in the combustion chamber 20 is combusted as an ignition plug 24 discharges a spark. The combustion energy generated at that time is converted into rotational energy of a crankshaft 26.

The air-fuel mixture combusted in the combustion chamber 20 is discharged to an exhaust passage 30 as exhaust gas as an exhaust valve 28 is opened. The exhaust passage 30 is provided with a three-way catalyst 32, which has an oxygen storage capability and a gasoline particulate filter (GPF) 34. In the present embodiment, the GPF 34 is assumed to be a filter which traps particulate matter (PM) and on which a three-way catalyst which has an oxygen storage capability is carried.

The crankshaft 26 is mechanically coupled to a carrier C of a planetary gear mechanism 50, which constitutes a power splitting device. A rotary shaft 52*a* of a first motor/generator 52 is mechanically coupled to a sun gear S of the planetary gear mechanism 50. In addition, a rotary shaft 54*a* of a second motor/generator 54 and drive wheels 60 are mechanically coupled to a ring gear R of the planetary gear mechanism 50. An alternating voltage is applied to terminals of the first motor/generator 52 by an inverter 56. In addition, an alternating voltage is applied to terminals of the second motor/generator 54 by an inverter 58.

An electronic control unit (ECU) 70 controls the internal combustion engine 10, and operates operable portions of the internal combustion engine 10 such as the throttle valve 14, the port injection valve 16, the in-cylinder injection valve 22, and the ignition plug 24, in order to control torque, the exhaust component ratio, etc. which are control amounts of the internal combustion engine 10. The electronic control unit 70 also controls the first motor/generator 52, and operates the inverter 56, in order to control the rotational speed, which is a control amount of the first motor/generator 52. The electronic control unit 70 also controls the second motor/generator 54, and operates the inverter 58, in order to control torque, which is a control amount of the second motor/generator 54. Operation signals MS1 to MS6 for the throttle valve 14, the port injection valve 16, the in-cylinder injection valve 22, the ignition plug 24, and the inverters 56 and 58, respectively, are indicated in FIG. 1. The electronic control unit 70 references an intake air amount Ga detected by an airflow meter 80, an output signal Scr from a crank angle sensor 82, and a coolant temperature THW detected by a coolant temperature sensor 84, in order to control the control amounts of the internal combustion engine 10. The electronic control unit 70 also references an upstream air-fuel ratio Afu detected by an upstream air-fuel ratio sensor 86 provided upstream of the three-way catalyst 32 and a downstream air-fuel ratio Afd detected by a downstream air-fuel ratio sensor 88 provided downstream of the three-way catalyst 32. The electronic control unit 70 also references an output signal Sm1 from a first rotational angle sensor 90 that detects the rotational angle of the first motor/generator 52, in order to control the control amount of the first motor/generator 52. The electronic control unit 70 also references an output signal Sm2 from a second rotational angle sensor 92 that detects the rotational angle of the second motor/generator 54, in order to control the control amount of the second motor/generator 54. The electronic control unit 70 also references an accelerator operation amount ACCP, which is the amount of depression of an accelerator pedal detected by an accelerator sensor 94.

The electronic control unit 70 includes a central processing unit (CPU) 72, a read only memory (ROM) 74, and a peripheral circuit 76, which can communicate with each other through a communication line 78. The peripheral circuit 76 includes a circuit that generates a clock signal that prescribes internal operation, a power source circuit, a reset circuit, etc. The electronic control unit 70 controls the control amounts by the CPU 72 executing a program stored in the ROM 74.

In the following, processes executed by the electronic control unit 70 will be described in the order of a basic process, a process of reproducing the GPF 34, and the details of a recovery-time coefficient calculation process which is a part of the process in FIG. 2.

First, the basic process will be described. FIG. 2 illustrates a process executed by the electronic control unit 70. The processes illustrated in FIG. 2 are implemented by the CPU 72 executing the program stored in the ROM 74.

In a base injection amount calculation process M10, a base injection amount Qb which is a base value of the amount of fuel for bringing the air-fuel ratio of the air-fuel mixture in the combustion chamber 20 to a target air-fuel ratio is calculated based on a charging efficiency η. Particularly, in the base injection amount calculation process M10, the base injection amount Qb may be calculated by multiplying an amount of fuel QTH per 1% in terms of the charging efficiency η for bringing the air-fuel ratio to the target air-fuel ratio by the charging efficiency η when the charging efficiency η is expressed in percentage, for example. The base injection amount Qb is the amount of fuel that is calculated based on the amount of air to be charged into the combustion chamber 20 in order to bring the air-fuel ratio to the target air-fuel ratio. In the present embodiment, incidentally, the target air-fuel ratio is the stoichiometric air-fuel ratio. The charging efficiency η is calculated by the CPU 72 based on the intake air amount Ga and a rotational speed NE. The rotational speed NE is calculated by the CPU 72 based on the output signal Scr.

In a feedback coefficient calculation process M12, a feedback correction coefficient KAF is calculated and output. The feedback correction coefficient KAF is a value obtained by adding "1" to a correction proportion 5 for the base injection amount Qb as a feedback operation amount which is an operation amount for controlling the upstream air-fuel ratio Afu to a target value Afu* through feedback control. In the feedback coefficient calculation process M12, particularly, the correction proportion 5 is the sum of respective output values from a proportional element and a differential element to which the difference between the upstream air-fuel ratio Afu and the target value Afu* is input and an output value from an integral element that holds and outputs an integral value of a value that matches the difference.

In a switching process M14, the target value Afu* is switched from one of two values including a feedback rich air-fuel ratio Afr and a feedback lean air-fuel ratio Afl to the other and vice versa alternately. In the switching process M14, the target value Afu* is switched to the feedback rich air-fuel ratio Afr when the logical sum of the following conditions is true.

An oxygen storage amount OS is equal to or more than a switching upper limit value OSfl.

The downstream air-fuel ratio Afd is equal to or more than "Afs+Δ". A stoichiometric point Afs corresponds to the stoichiometric air-fuel ratio. In addition, a minute amount Δ is about 0.1 to 0.3, for example.

In the switching process M14, in addition, the target value Afu* is switched to the feedback lean air-fuel ratio Afl when the logical sum of the following conditions is true.

The oxygen storage amount OS is equal to or less than a switching lower limit value OSfr.

The downstream air-fuel ratio Afd is equal to or less than "Afs−Δ". The switching process M14 includes a process of calculating the oxygen storage amount OS based on the intake air amount Ga and the upstream air-fuel ratio Afu.

In a storage amount calculation process M16, the oxygen storage amount OS of the three-way catalyst 32 is calculated based on a required injection amount Qd, to be discussed later, and the intake air amount Ga. In a recovery-time coefficient calculation process M18, a value that is larger than "1" is calculated as a recovery-time coefficient Kc which is a correction coefficient for increasing the base injection amount Qb at the time of recovery from an all-cylinder fuel cut process M22*a*, to be discussed later, etc.

In a required injection amount calculation process M20, the amount of fuel (required injection amount Qd) required in one combustion cycle is calculated by multiplying the base injection amount Qb by the feedback correction coefficient KAF and the recovery-time coefficient Kc.

In an injection valve operation process M22, an operation signal MS2 is output to the port injection valve 16 in order to operate the port injection valve 16, and an operation signal MS3 is output to the in-cylinder injection valve 22 in order to operate the in-cylinder injection valve 22. In the injection valve operation process M22, in particular, the amount of fuel injected from the port injection valve 16 and the in-cylinder injection valve 22 in one combustion cycle is caused to match the required injection amount Qd.

In addition, the injection valve operation process M22 includes an all-cylinder fuel cut process M22*a*. In the all-cylinder fuel cut process M22*a*, injection of fuel into all the cylinders #1 to #4 is stopped. Conditions for executing the all-cylinder fuel cut process M22*a* include the following conditions, for example.

There is a request to apply friction torque due to the internal combustion engine 10 to the drive wheels 60.

A diagnosis process, conditions for execution of which include fuel injection being stopped, is executed.

The accelerator pedal is released with the temperature of the GPF 34 raised because of high-load operation. The fuel cut process is executed in this case in order to combust and remove the PM trapped by the GPF 34 by supplying oxygen to the GPF 34 with the temperature of the GPF 34 raised along with operation by a driver.

Next, a process of reproducing the GPF 34 will be described. The electronic control unit 70 basically performs the process illustrated in FIG. 2, but changes the process illustrated in FIG. 2 during the process of reproducing the GPF 34, in which the temperature of the GPF 34 is intentionally raised. The process will be described below.

Figure 3:
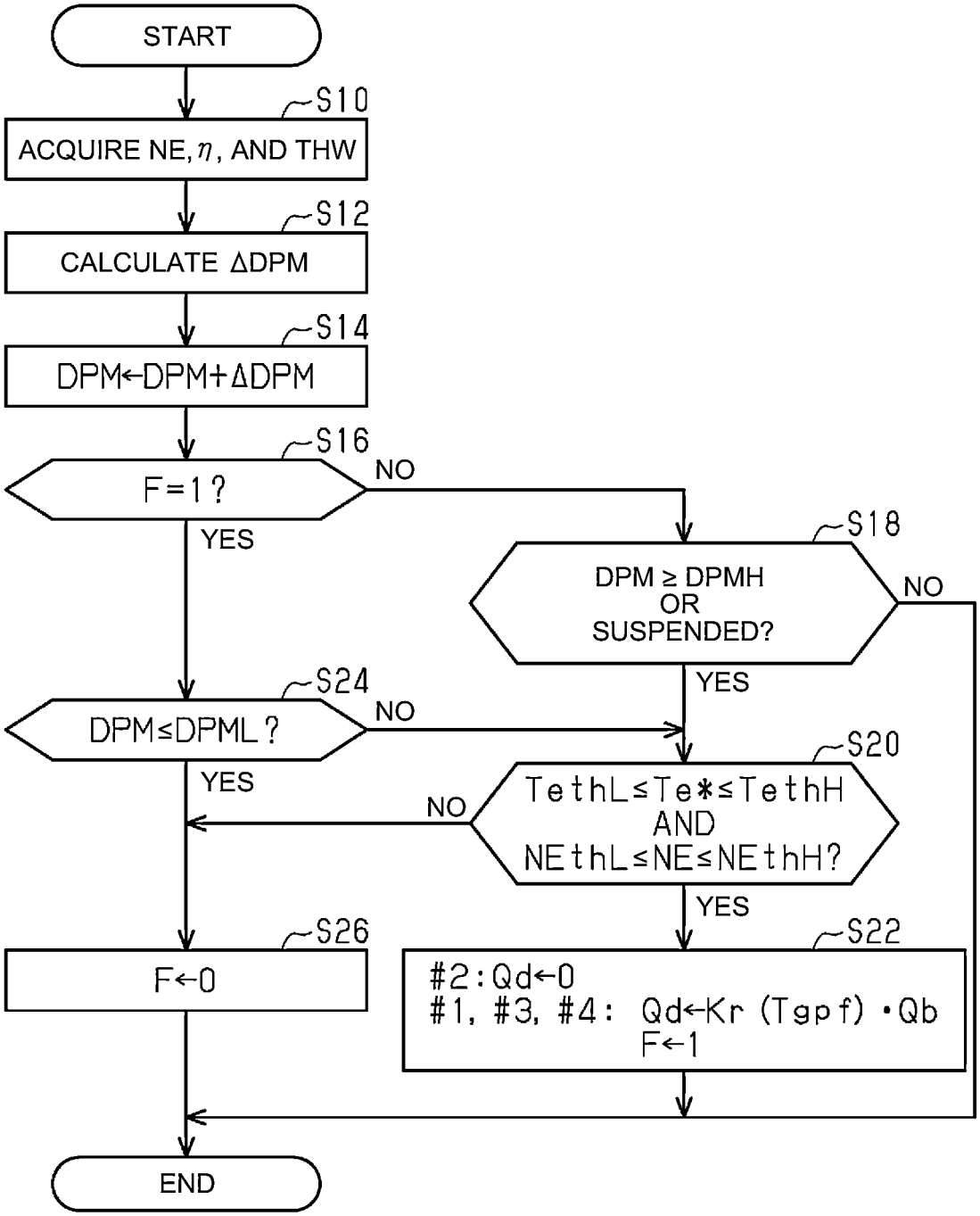
FIG. 3 is a flowchart illustrating the procedure of the process executed by the control device according to the embodiment.

FIG. 3 illustrates the procedure of the reproduction process. Processes illustrated in FIG. 3 are implemented by the CPU 72 executing the program stored in the ROM 74 repeatedly in a predetermined cycle, for example. In the following, the respective step numbers of the processes are represented by numerals preceded by the letter S.

In the sequence of processes illustrated in FIG. 3, the CPU 72 first acquires a rotational speed NE, a charging efficiency η, and a coolant temperature THW (S10). Next, the CPU 72 calculates an update amount ΔDPM of a deposit amount DPM based on the rotational speed NE, the charging efficiency η, and the coolant temperature THW (S12). The deposit amount DPM is the amount of PM trapped by the GPF 34. Particularly, the CPU 72 calculates the amount of PM in the exhaust gas discharged to the exhaust passage 30 based on the rotational speed NE, the charging efficiency η and the coolant temperature THW. The CPU 72 also calculates a temperature Tgpf of the GPF 34 based on the rotational speed NE and the charging efficiency η. Then, the CPU 72 calculates the update amount ΔDPM based on the amount of PM in the exhaust gas and the temperature of the GPF 34. During execution of the process in S22 to be discussed later, the temperature Tgpf and the update amount ΔDPM may be calculated based on an increase coefficient Kr.

Next, the CPU 72 updates the deposit amount DPM in accordance with the update amount ΔDPM (S14). Next, the CPU 72 determines whether an execution flag F is set to "1" (S16). The execution flag F indicates that a temperature raising process for combusting and removing PM on the GPF 34 is being executed when the execution flag F is set to "1", and indicates otherwise when the execution flag F is set to "0". When it is determined that the execution flag is set to "0" (S16: NO), the CPU 72 determines whether the logical sum of the deposit amount DPM being equal to or more than a reproduction execution value DPMH and the process in S22, to be discussed later, being suspended is true (S18). The reproduction execution value DPMH is set to a value at which the amount of PM trapped by the GPF 34 has become large and it is desirable to remove the PM.

When it is determined that the logical sum is true (S18: YES), the CPU 72 determines whether the logical product of the following conditions (a) and (b), which are conditions for executing the temperature raising process, is true (S20).

Condition (a): An engine torque command value Te*, which is a command value for torque for the internal combustion engine 10, is equal to or more than lower limit torque TethL and equal to or less than upper limit torque TethH. Condition (b): The rotational speed NE of the internal combustion engine 10 is equal to or more than a lower limit speed NEthL and equal to or less than an upper limit speed NEthH.

In an operation state in which the upper limit torque TethH and the upper limit speed NEthH are exceeded, the temperature of the exhaust gas is high in the first place, and the deposit amount DPM is not likely to be increased even if the process in S22, to be discussed later, is not executed.

When it is determined that the logical product is true (S20: YES), the CPU 72 executes the temperature raising process, and substitutes "1" into the execution flag F (S22). In the temperature raising process according to the present embodiment, the CPU 72 stops injection of fuel from the port injection valve 16 and the in-cylinder injection valve 22 for the cylinder #2, and makes the air-fuel ratio of the air-fuel mixture in the combustion chambers 20 for the cylinders #1, #3, and #4 richer than the stoichiometric air-fuel ratio. This process is intended, firstly, to raise the temperature of the three-way catalyst 32. That is, the temperature of the three-way catalyst 32 is raised by oxidizing unburned fuel at the three-way catalyst 32 by discharging oxygen and unburned fuel to the exhaust passage 30. Secondly, the process is intended to raise the temperature of the GPF 34 and supply oxygen to the GPF 34 that has become hot to oxidize and remove the PM trapped by the GPF 34. That is, when the temperature of the three-way catalyst 32 has become high, exhaust gas at a high temperature flows into the GPF 34 to raise the temperature of the GPF 34. Then, when oxygen flows into the GPF 34 that has become hot, the PM trapped by the GPF 34 is oxidized and removed.

Particularly, the CPU 72 substitutes "0" into the required injection amount Qd for the port injection valve 16 and the in-cylinder injection valve 22 for the cylinder #2. On the other hand, the CPU 72 substitutes a value obtained by multiplying the base injection amount Qb by the increase coefficient Kr into the required injection amount Qd for the cylinders #1, #3, and #4.

The CPU 72 sets the increase coefficient Kr such that unburned fuel in the exhaust gas discharged from the cylinders #1, #3, and #4 to the exhaust passage 30 is in such an amount that the unburned fuel is just enough to react with oxygen discharged from the cylinder #2. Particularly, the CPU 72 increases the value of the increase coefficient Kr when the temperature Tgpf of the GPF 34 is low compared to when the temperature Tgpf is high. That is, the CPU 72 sets the air-fuel ratio of the air-fuel mixture in the cylinders #1, #3, and #4 to a value that is as close as possible to a value corresponding to the amount of the unburned fuel that is just enough to react with the oxygen, in order to raise the temperature of the three-way catalyst 32 quickly at the initial stage of the process of reproducing the GPF 34.

When it is determined that the execution flag F is set to "1" (S16: YES), on the other hand, the CPU 72 determines whether the deposit amount DPM is equal to or less than a stop threshold DPML (S24). The stop threshold DPML is set to a value at which the amount of PM trapped by the GPF 34 is so small that the reproduction process may be stopped. When it is determined that the deposit amount DPM is not equal to or less than the stop threshold DPML (S24: NO), the CPU 72 transitions to the process in S20.

When the deposit amount DPM is equal to or less than the stop threshold DPML (S24: YES), and when a negative determination is made in the process in S20, on the other hand, the CPU 72 stops or suspends the process in S22, and substitutes "0" into the execution flag F (S26). The process in S22 is stopped as having been completed when an affirmative determination is made in the process in S24, and the process in S22 is suspended before being completed when a negative determination is made in the process in S20.

Figure 2:
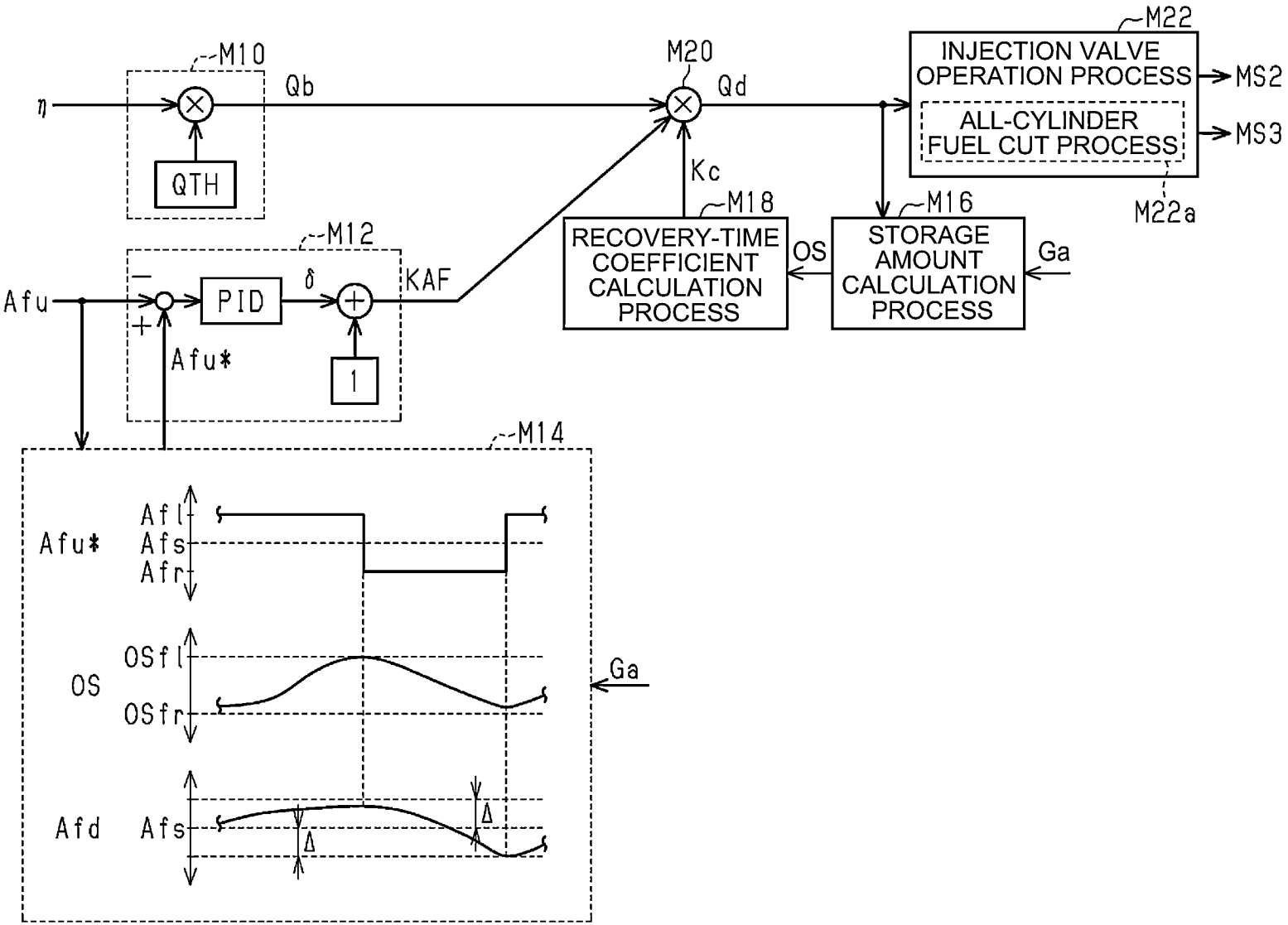
FIG. 2 is a block diagram illustrating a part of a process executed by the control device according to the embodiment.

The CPU 72 temporarily stops the sequence of processes illustrated in FIG. 2 when the processes in S22 and S26 are completed or when a negative determination is made in the process in S18.

Details of Recovery-Time Coefficient Calculation Process

Figure 4:
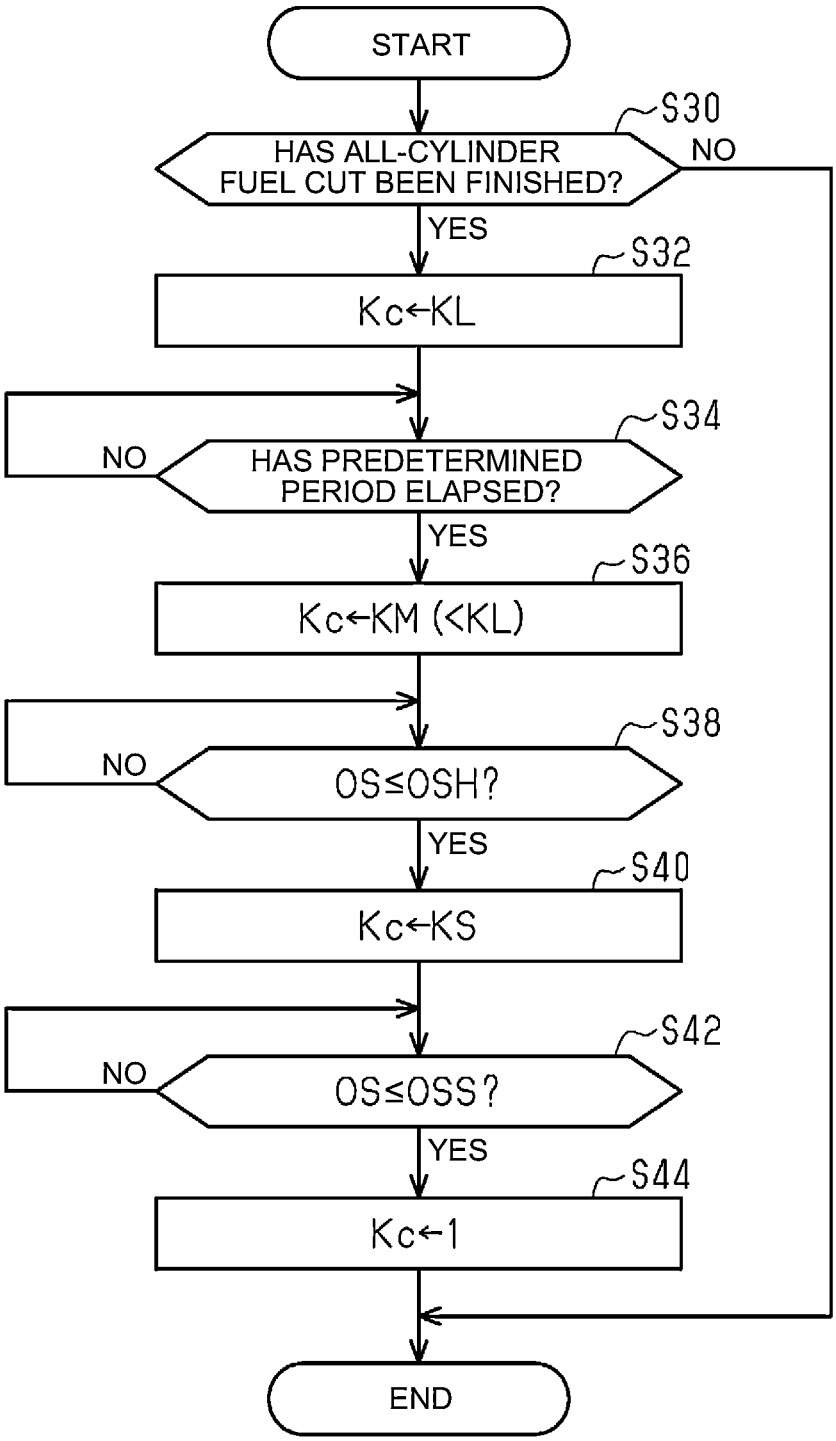
FIG. 4 is a flowchart illustrating the procedure of the process executed by the control device according to the embodiment.

FIG. 4 illustrates the procedure of a process related to the calculation of the recovery-time coefficient Kc performed after the all-cylinder fuel cut process M22*a* is stopped. Processes illustrated in FIG. 4 are implemented by the CPU 72 executing the program stored in the ROM 74 repeatedly in a predetermined cycle, for example.

In the sequence of processes illustrated in FIG. 4, the CPU 72 first determines whether the all-cylinder fuel cut process M22*a* has been finished (S30). When it is determined that the process has been finished (S30: YES), the CPU 72 substitutes a maximum coefficient KL into the recovery-time coefficient Kc (S32). This process is targeted at immediately decreasing oxygen at the upstream end of the three-way catalyst 32. Then, the CPU 72 stands by for a predetermined period (S34: NO). The predetermined period may be one combustion cycle, or may be two combustion cycles, for example. If the interval corresponds to the rotational angle of the crankshaft 26 in this manner, it is easy to determine the number of times of injection of fuel, the amount of which has been increased using the maximum coefficient KL.

When the predetermined period has elapsed (S34: YES), the CPU 72 substitutes an intermediate coefficient KM into the recovery-time coefficient Kc (S36). The intermediate coefficient KM is smaller than the maximum coefficient KL. Then, the CPU 72 stands by until the oxygen storage amount OS becomes equal to or less than a prescribed value OSH (S38: NO). The prescribed value OSH is set in accordance with the lower limit value of a value at which unburned fuel may flow out downstream of the three-way catalyst 32 if the recovery-time coefficient Kc is set to the intermediate coefficient KM. It is not meant that the prescribed value OSH is less than the amount of oxygen that is just enough to react with unburned fuel that flows into the three-way catalyst 32 with the intermediate coefficient KM. When the oxygen storage amount OS becomes small, unburned fuel may flow out downstream of the three-way catalyst 32 because of a reduction in the reaction rate, even if an amount of oxygen that is just enough to react with unburned fuel that flows into the three-way catalyst 32 has been stored.

When it is determined that the oxygen storage amount OS is equal to or less than the prescribed value OSH (S38: YES), the CPU 72 substitutes a minimum coefficient KS into the recovery-time coefficient Kc (S40). Then, the CPU 72 stands by until the oxygen storage amount OS becomes equal to or less than a predetermined value OSS (S42). The predetermined value OSS is set to a value for determining that the effect of the all-cylinder fuel cut process M22*a* has been resolved and that the three-way catalyst 32 has been returned to a normal state. When it is determined that the oxygen storage amount OS has become equal to or less than the predetermined value OSS (S42: YES), the CPU 72 substitutes "1" into the recovery-time coefficient Kc (S44).

Figure 5:
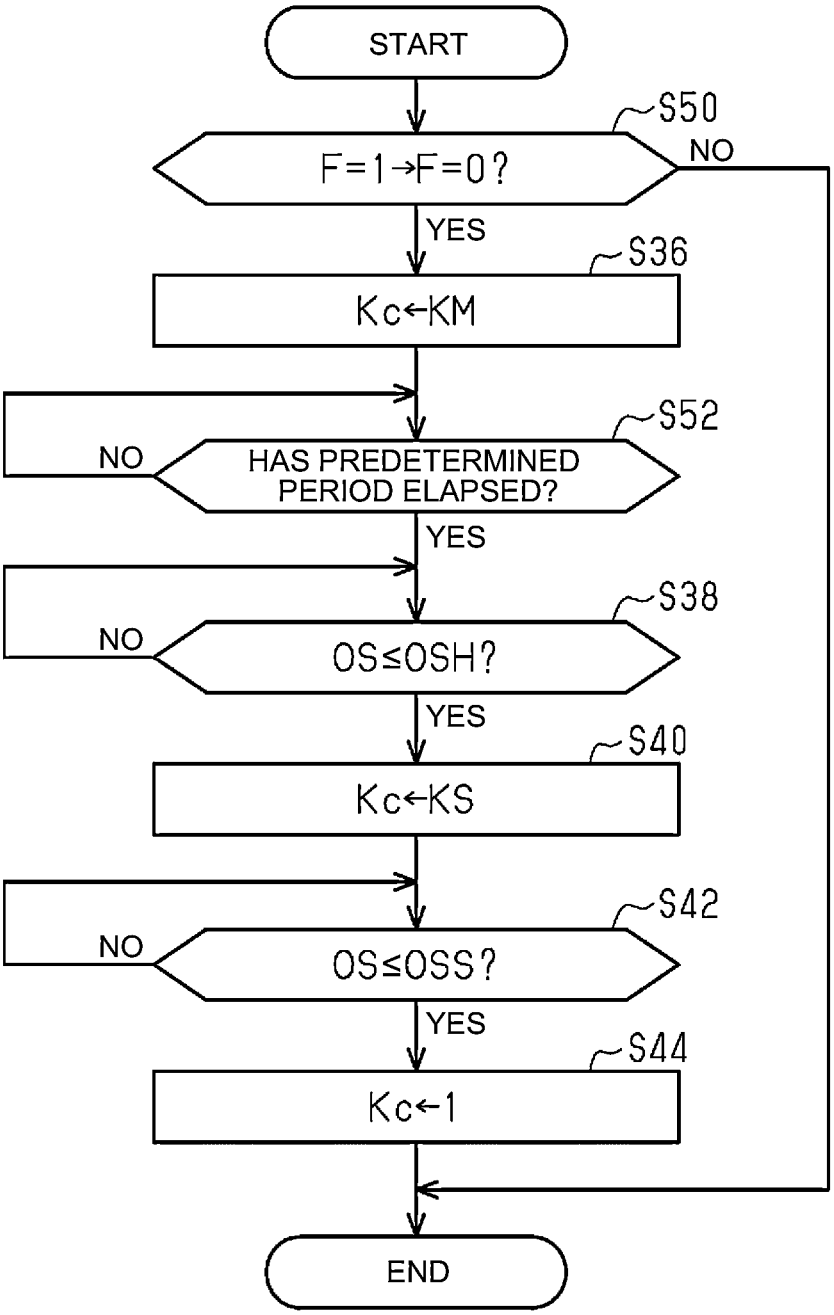
FIG. 5 is a flowchart illustrating the procedure of the process executed by the control device according to the embodiment.

The CPU 72 temporarily stops the sequence of processes illustrated in FIG. 4 when the process in S44 is completed or when a negative determination is made in the process in S30. FIG. 5 illustrates the procedure of a process related to the calculation of the recovery-time coefficient Kc performed after the temperature raising process is stopped. Processes illustrated in FIG. 5 are implemented by the CPU 72 executing the program stored in the ROM 74 repeatedly in a predetermined cycle, for example. The processes in FIG. 5 corresponding to the processes illustrated in FIG. 4 are given the same step numbers for convenience.

In the sequence of processes illustrated in FIG. 5, the CPU 72 determines whether the execution flag F has been switched from "1" to "0" (S50). In this process, it is determined whether the temperature raising process has been stopped. When it is determined that the execution flag F has been switched (S50: YES), the CPU 72 substitutes the intermediate coefficient KM into the recovery-time coefficient Kc (S36). Then, the CPU 72 stands by for a predetermined period (S52: NO). The predetermined period is a period that is an integer multiple of the interval of appearance of the compression top dead center. Specifically, the predetermined period may be one combustion cycle, for example. When the predetermined period has elapsed (S52: YES), the CPU 72 stands by until the oxygen storage amount OS becomes equal to or less than the prescribed value OSH (S38: NO), and substitutes the minimum coefficient KS into the recovery-time coefficient Kc (S40). When the oxygen storage amount OS has already become equal to or less than the prescribed value OSH when or before the predetermined period elapses, the CPU 72 substitutes the minimum coefficient KS into the recovery-time coefficient Kc when the predetermined period elapses.

The CPU 72 temporarily stops the sequence of processes illustrated in FIG. 5 when the process in S44 is completed or when a negative determination is made in the process in S50. The functions and the effects of the present embodiment will be described.

Figure 6:
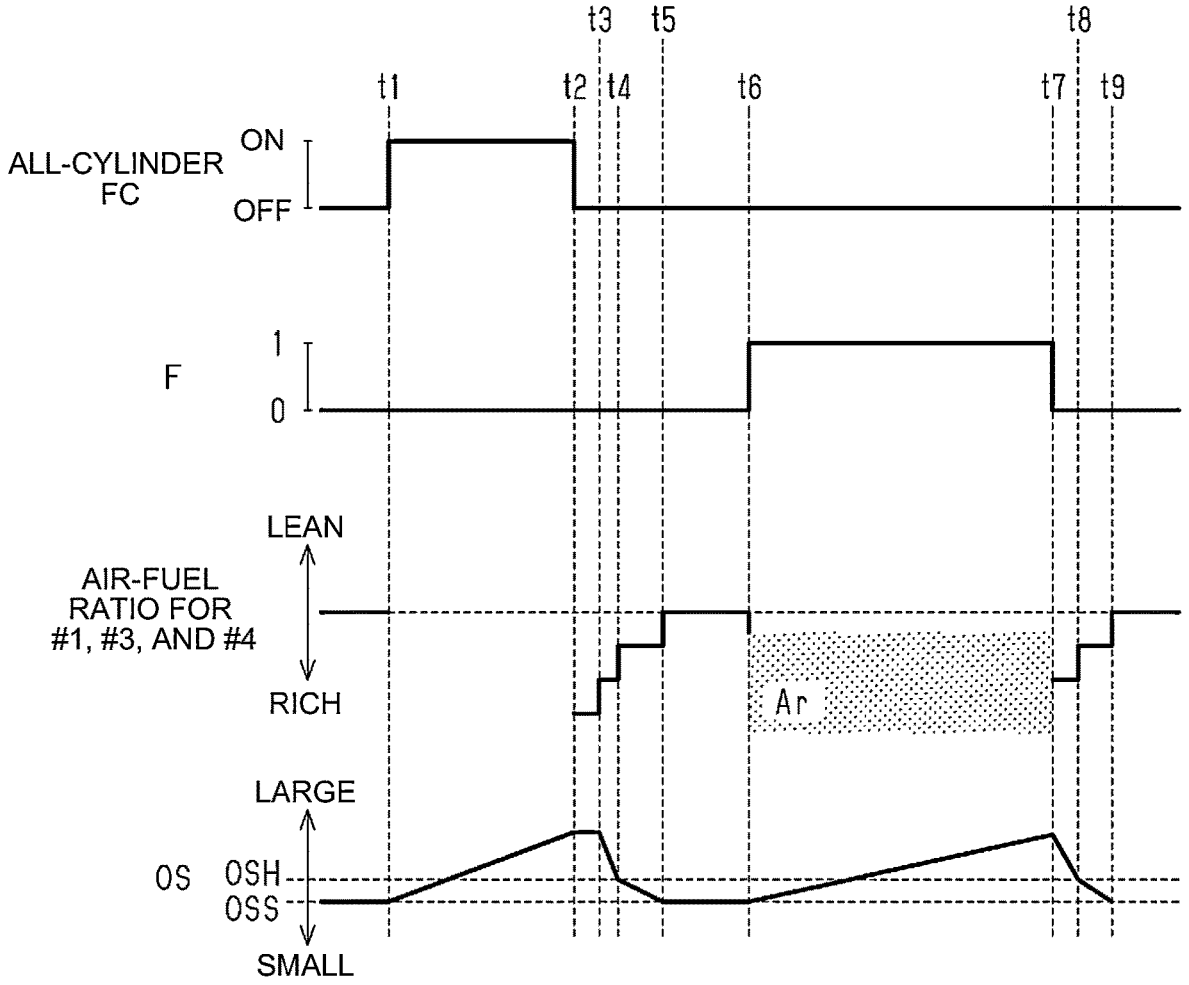
FIG. 6 is a time chart illustrating the functions of the embodiment.

FIG. 6 illustrates the transition in the air-fuel ratio for the cylinders #1, #3, and #4 due to the recovery-time coefficient Kc. When the all-cylinder fuel cut process M22*a* is executed at time t1, as illustrated in FIG. 6, the oxygen storage amount OS is increased. The air-fuel ratio for the cylinders #1, #3, and #4 is not illustrated for a period from time t1 to time t2, for which the all-cylinder fuel cut process M22*a* is performed, and this is because the injection amount is zero and therefore the air-fuel ratio cannot be defined.

When the all-cylinder fuel cut process M22*a* is stopped at time t2, the CPU 72 sets the recovery-time coefficient Kc to the maximum coefficient KL, and thus the air-fuel ratio of the air-fuel mixture in the cylinders #1, #3, and #4 becomes significantly low. The air-fuel ratio here may be equal to or less than "10", for example. This allows a large amount of unburned fuel to flow into the three-way catalyst 32, which makes it possible to immediately consume oxygen at the upstream end of the three-way catalyst 32 after the all-cylinder fuel cut process M22*a* is stopped. At time t3 when the predetermined period elapses, the CPU 72 sets the recovery-time coefficient Kc to the intermediate coefficient KM, and thus the air-fuel ratio of the air-fuel mixture in the cylinders #1, #3, and #4 is raised. The air-fuel ratio here may be about "11 to 13", for example.

Then, the CPU 72 substitutes the minimum coefficient KS into the recovery-time coefficient Kc at time t4 when the oxygen storage amount OS becomes equal to or less than the prescribed value OSH. Consequently, the air-fuel ratio of the air-fuel mixture in the cylinders #1, #3, and #4 is further raised, although still lower than the stoichiometric air-fuel ratio. The air-fuel ratio here may be about "13 to 14", for example.

Then, the CPU 72 substitutes "1" into the recovery-time coefficient Kc at time t5 when the oxygen storage amount OS becomes equal to or less than the predetermined value OSS. Then, the CPU 72 calculates the required injection amount Qd in accordance with the feedback correction coefficient KAF. Consequently, the air-fuel ratio of the air-fuel mixture in the cylinders #1, #3, and #4 is controlled to the target value Afu* through feedback control. In other words, the air-fuel ratio is controlled to the feedback rich air-fuel ratio Afr and the feedback lean air-fuel ratio Afl. The feedback rich air-fuel ratio Afr is higher than the air-fuel ratio of the air-fuel mixture in the cylinders #1, #3, and #4 at the time when the minimum coefficient KS is substituted into the recovery-time coefficient Kc.

When the temperature raising process is started at time t6, meanwhile, the CPU 72 makes the air-fuel ratio of the air-fuel mixture in the cylinders #1, #3, and #4 richer than the stoichiometric air-fuel ratio. The air-fuel ratio at this time is set to an appropriate value in a region Ar in accordance with the temperature Tgpf of the GPF 34. The upper limit value of the region Ar is more than the air-fuel ratio achieved with the minimum coefficient KS, and less than the feedback rich air-fuel ratio Afr. Meanwhile, the lower limit value of the region Ar is less than the air-fuel ratio achieved with the maximum coefficient KL.

Then, the CPU 72 substitutes the intermediate coefficient KM into the recovery-time coefficient Kc at and after time t7 when the temperature raising process is stopped. Then, the CPU 72 substitutes the minimum coefficient KS into the recovery-time coefficient Kc at time t8 when the oxygen storage amount OS becomes equal to or less than the prescribed value OSH. Then, the CPU 72 substitutes "1" into the recovery-time coefficient Kc at time t9 when the oxygen storage amount OS becomes equal to or less than the predetermined value OSS. Then, the CPU 72 calculates the required injection amount Qd in accordance with the feedback correction coefficient KAF. Consequently, the air-fuel ratio of the air-fuel mixture in the cylinders #1, #3, and #4 is controlled to the target value Afu* through feedback control.

A reduction in the rate of reduction of NOx by the three-way catalyst 32 after the stop of the temperature raising process can be suppressed in this manner by setting the recovery-time coefficient Kc to the intermediate coefficient KM as the temperature raising process is stopped. With the present embodiment described above, the following functions and effects can be further obtained.

After the temperature raising process is stopped, the value of the recovery-time coefficient Kc is increased, and thereafter reduced stepwise in the range of more than "1". When a large amount of fuel flows into the three-way catalyst 32 when the oxygen storage amount OS is small, a part of the fuel may flow out downstream of the three-way catalyst 32, even if the amount of oxygen stored in the three-way catalyst 32 is equal to or more than the amount of oxygen that is just enough to react with the fuel. In the present embodiment, in this respect, the recovery-time coefficient Kc is reduced stepwise. Consequently, it is possible to quickly resolve a state in which the oxygen storage amount OS is large and the NOx reduction rate tends to be lowered, and suppress fuel flowing out downstream of the three-way catalyst 32, at the same time.

The CPU 72 sets the recovery-time coefficient Kc to the intermediate coefficient KM for a predetermined period after the temperature raising process is stopped, even if the oxygen storage amount OS is equal to or less than the prescribed value OSH. This is made in view of the possibility that the NOx reduction rate may be lowered when the recovery-time coefficient Kc is set to the minimum coefficient KS, even if the calculated oxygen storage amount OS is equal to or less than the prescribed value OSH, after the temperature raising process is stopped. Particularly, it is made in view of the possibility that the NOx reduction rate may be lowered when the intake air amount Ga becomes excessively large because of an abrupt increase in the accelerator operation amount ACCP etc. That is, a reduction in the NOx reduction rate can be suppressed by providing a period for which the recovery-time coefficient Kc is temporarily set to the intermediate coefficient KM.

The value of the recovery-time coefficient Kc at the time when the temperature raising process is stopped is made smaller than the value of the recovery-time coefficient Kc at the time when all-cylinder fuel cut process M22*a* is stopped. When the state of the three-way catalyst 32 at the time immediately after the temperature raising process is stopped is compared with the state of the three-way catalyst 32 at the time immediately after the all-cylinder fuel cut process M22*a* is stopped, the amount of fuel that is necessary to suppress a reduction in the NOx reduction rate tends to be small in the former state. When the value of the recovery-time coefficient Kc at the time when the temperature raising process is stopped is set to be equal to the value of the recovery-time coefficient Kc at the time when the all-cylinder fuel cut process is stopped in spite of the tendency described above, the fuel consumption rate may be unnecessarily lowered. In the present embodiment, in this respect, it is possible to suppress both a reduction in the NOx reduction rate and an increase in the fuel consumption rate, by making the value of the recovery-time coefficient Kc at the time when the temperature raising process is stopped smaller than the value of the recovery-time coefficient Kc at the time when the all-cylinder fuel cut process M22*a* is stopped.

The correspondence between the matters in the embodiment described above and the matters described in the "SUMMARY" field is as follows. In the following, the correspondence is described for each element described in the "SUMMARY" field. The post-processing device corresponds to the three-way catalyst 32 and the GPF 34. The catalyst corresponds to the three-way catalyst 32. The temperature raising process corresponds to the process in S22. The recovery-time process corresponds to the process in FIG. 5. The specific post-stop air-fuel ratio corresponds to the air-fuel ratio at the time when the recovery-time coefficient Kc is set to the intermediate coefficient KM or the minimum coefficient KS. The upper limit air-fuel ratio and the lower limit air-fuel ratio correspond to the upper limit value and the lower limit value, respectively, of the region Ar illustrated in FIG. 6. The feedback process corresponds to the feedback coefficient calculation process M12 and the injection valve operation process M22. The switching process corresponds to the switching process M14. The specific post-stop air-fuel ratio corresponds to the air-fuel ratio at the time when the recovery-time coefficient Kc is set to the intermediate coefficient KM or the minimum coefficient KS. The specific post-stop air-fuel ratio corresponds to the increase coefficient being set through the process in FIG. 5 for all the cylinders after the temperature raising process is stopped. The all-cylinder fuel cut process corresponds to the all-cylinder fuel cut process M22*a*. The post-all-stop air-fuel ratio corresponds to the air-fuel ratio at the time when the recovery-time coefficient Kc is set to the maximum coefficient KL. The storage amount calculation process corresponds to the storage amount calculation process M16. The change process corresponds to the processes in S38 to S44. The first rich air-fuel ratio corresponds to the air-fuel ratio achieved with the intermediate coefficient KM. The second rich air-fuel ratio corresponds to the air-fuel ratio achieved with the minimum coefficient KS. The forced rich process corresponds to the process in S36 being executed when a negative determination is made in the process in S52.

Next, modifications of the embodiment of the present disclosure will be described. The present embodiment can be implemented as modified in the modifications described below. The present embodiment and the modifications can be implemented in combination with each other unless the embodiment and the modifications technically contradict with each other.

The specific post-stop air-fuel ratio will be described.

The specific post-stop air-fuel ratio is not limited to an air-fuel ratio that is equal to the air-fuel ratio achieved with the intermediate coefficient KM or the air-fuel ratio achieved with the minimum coefficient KS which is used after the all-cylinder fuel cut process M22*a* is stopped. In other words, it is not essential that the value of the recovery-time coefficient Kc should be equal to the value used after the all-cylinder fuel cut process M22*a* is stopped.

The specific post-stop air-fuel ratio is not limited to including two values. For example, the specific post-stop air-fuel ratio may include three or more values, and may be decreased stepwise as the oxygen storage amount is decreased. Also in that case, it is desirable that the maximum value of the specific post-stop air-fuel ratio should be less than the feedback rich air-fuel ratio Afr. The minimum value of the specific post-stop air-fuel ratio being made more than the air-fuel ratio achieved with the maximum coefficient KL is effective in suppressing an increase in the fuel consumption rate.

The specific post-stop air-fuel ratio is not limited to a plurality of values that is increased as the oxygen storage amount OS is decreased. For example, the specific post-stop air-fuel ratio can also be a fixed value for an internal combustion engine, for which the speed of a rise in the intake air amount Ga after the temperature raising process can be suppressed. Examples of such an internal combustion engine include an internal combustion engine to be mounted on a vehicle, for which it is not necessary to increase the output of the internal combustion engine 10 immediately in accordance with the required value of the drive force etc., such as a series hybrid vehicle to be described in the following description of the vehicle.

It is not essential that the specific post-stop air-fuel ratio should be set between the upper limit air-fuel ratio and the lower limit air-fuel ratio of the air-fuel ratio for the cylinders #1, #3, and #4 during the temperature raising process.

Next, the forced rich process will be described.

While the predetermined period in the process in S52 is an integer multiple of the interval of appearance of the compression top dead center with the integer being a fixed value determined in advance in the embodiment described above, the present disclosure is not limited thereto. For example, the integer may be variable in accordance with the oxygen storage amount OS.

It is not essential to perform the forced rich process. This is not limited to the case where the specific post-stop air-fuel ratio is a fixed value, as described for the specific post-stop air-fuel ratio. For example, the specific post-stop air-fuel ratio may be set to the minimum coefficient KS from the beginning if the oxygen storage amount OS is equal to or less than the predetermined value OSS, even when the specific post-stop air-fuel ratio is to be decreased in accordance with the oxygen storage amount, for an internal combustion engine, for which the speed of a rise in the intake air amount Ga after the temperature raising process can be suppressed.

Next, the post-all-stop air-fuel ratio will be described.

The post-all-stop air-fuel ratio is not limited to the three values. For example, the post-all-stop air-fuel ratio may have four or more values, and may be increased stepwise as the oxygen storage amount OS is decreased. Alternatively, the post-all-stop air-fuel ratio may include two values, for example. Further, the post-all-stop air-fuel ratio may include a single value for an internal combustion engine, for which the speed of a rise in the intake air amount Ga after the all-cylinder fuel cut process can be suppressed. Examples of such an internal combustion engine include an internal combustion engine to be mounted on a vehicle, for which it is not necessary to increase the output of the internal combustion engine 10 immediately in accordance with the required value of the drive force etc., such as a series hybrid vehicle to be described in the following description of the vehicle.

Next, the switching process will be described.

While an oxygen storage amount is calculated in the switching process M14 independently of the storage amount calculation process M16 in the embodiment described above, the present disclosure is not limited thereto. For example, the oxygen storage amount OS that is calculated in the storage amount calculation process M16 may be input.

The condition for switching the target value Afu* to the feedback lean air-fuel ratio Afl is not limited to the logical sum of the oxygen storage amount OS being equal to or less than the switching lower limit value OSfr and the downstream air-fuel ratio Afd being equal to or less than "Afs−Δ" being true. For example, the condition may be the oxygen storage amount OS being equal to or less than the switching lower limit value OSfr alone. Alternatively, the condition may be the downstream air-fuel ratio Afd being equal to or less than "Afs−Δ" alone, for example.

The condition for switching the target value Afu* to the feedback rich air-fuel ratio Afr is not limited to the logical sum of the oxygen storage amount OS being equal to or more than the switching upper limit value OSfl and the downstream air-fuel ratio Afd being equal to or more than "Afs+Δ" being true. For example, the condition may be the oxygen storage amount OS being equal to or more than the switching upper limit value OSfl alone. Alternatively, the condition may be the downstream air-fuel ratio Afd being equal to or more than "Afs+Δ" alone, for example.

Next, the storage amount calculation process will be described.

The storage amount calculation process is not limited to a process of calculating the oxygen storage amount OS based on the intake air amount Ga and the required injection amount Qd. For example, the charging efficiency η may be input in place of the intake air amount Ga as an intake air amount variable that is a variable that indicates the amount of air taken into the internal combustion engine 10, and the rotational speed NE and the upstream air-fuel ratio Afu may be input.

Next, the temperature raising process will be described.

While the number of cylinders, for which fuel supply is stopped in one cycle, is one in the process in S22, the present disclosure is not limited thereto. The number of such cylinders may be two, for example.

While the cylinder, for which fuel supply is stopped in each combustion cycle, is fixed at a cylinder determined in advance in the embodiment described above, the present disclosure is not limited thereto. The cylinder, for which fuel supply is stopped, may be changed in each predetermined cycle, for example.

The temperature raising process is not limited to a process, the cycle of which is set to one combustion cycle. When four cylinders are provided as in the embodiment described above, for example, a period that is five times the interval of appearance of the compression top dead center may be used as the cycle so that fuel supply to one of the cylinders is stopped in the period. This makes it possible to change the cylinder, for which fuel supply is stopped, in a cycle that is five times the interval of appearance of the compression top dead center.

Next, the conditions for executing the temperature raising process will be described.

While the conditions (a) and (b) are indicated as examples of the predetermined condition for executing the temperature raising process when there occurs a request to execute the temperature raising process in the embodiment described above, the predetermined condition is not limited thereto. For example, the predetermined condition may include only one of the two conditions (a) and (b).

Next, estimation of the deposit amount will be described.

The process of estimating the deposit amount DPM is not limited to that indicated in FIG. 3. For example, the deposit amount DPM may be estimated based on the difference in the pressure between the upstream side and the downstream side of the GPF 34 and the intake air amount Ga. Specifically, the deposit amount DPM may be estimated to have a large value when the difference in the pressure is large compared to when the difference in the pressure is small, and the deposit amount DPM may be estimated to have a large value when the intake air amount Ga is small compared to when the intake air amount Ga is large, even if the difference in the pressure is equal. When the pressure on the downstream side of the GPF 34 is considered to have a constant value, a detected value of the pressure on the upstream side of the GPF 34 can be used in place of the pressure difference.

Next, the post-processing device will be described.

The post-processing device is not limited to one in which the GPF 34 is provided downstream of the three-way catalyst 32, and may be one in which the three-way catalyst 32 is provided downstream of the GPF 34, for example. The post-processing device is also not limited to one that includes the three-way catalyst 32 and the GPF 34. For example, the post-processing device may include only the GPF 34. Even when the post-processing device includes only the three-way catalyst 32, for example, execution of the process described above in relation to the embodiment and the modifications thereof is effective if it is necessary to raise the temperature of the post-processing device during the reproduction process. When the post-processing device includes the GPF that is provided downstream of the three-way catalyst 32, the GPF is not limited to a filter that carries a three-way catalyst, and may be a filter alone.

Next, the electronic control unit will be described.

The electronic control unit is not limited to one that includes the CPU 72 and the ROM 74 and that executes software processing. For example, the electronic control unit may include a dedicated hardware circuit such as an application-specific integrated circuit (ASIC) that performs hardware processing for at least some of processes subjected to software processing in the embodiment described above. That is, the electronic control unit may include any of the following configurations (a) to (c). (a) The electronic control unit includes a processing device that executes all of the processes described above in accordance with a program and a program storage device, such as a ROM, that stores the program. (b) The electronic control unit includes a processing device that executes some of the processes described above in accordance with a program, a program storage device, and a dedicated hardware circuit that executes the remaining processes. (c) The electronic control unit includes a dedicated hardware circuit that executes all of the processes described above. The electronic control unit may include a plurality of software execution devices, which each includes a processing device and a program storage device, or dedicated hardware circuits.

Next, the vehicle will be described.

The vehicle is not limited to a series/parallel hybrid vehicle, and may be a parallel hybrid vehicle or a series hybrid vehicle, for example. The vehicle is not limited to a hybrid vehicle, and may be a vehicle that includes only the internal combustion engine 10 as a power generation device for the vehicle, for example.

What is claimed is:

1. A control device for a multi-cylinder internal combustion engine including a post-processing device that includes a catalyst having an oxygen storage capability and provided in an exhaust passage, the control device comprising an electronic control unit configured to execute:

an injection valve operation process for controlling an air-fuel ratio of an air-fuel mixture in first cylinders and second cylinders of a plurality of cylinders in the internal combustion engine;

a temperature raising process of raising a temperature of the post-processing device, the temperature raising process including a stopping process and a rich process, wherein in the stopping process, supply of fuel to the first cylinders of the plurality of cylinders is stopped, and in the rich process, the air-fuel ratio of the air-fuel mixture in the second cylinders of the plurality of cylinders is made lower than a stoichiometric air-fuel ratio, the second cylinders different from the first cylinders; and a recovery-time process in which, in response to the temperature raising process being stopped, a concentration of unburned fuel in exhaust gas discharged to the exhaust passage is made higher than an equivalent concentration, the equivalent concentration being a minimum concentration of unburned fuel to react with oxygen in the exhaust gas, wherein the electronic control unit is configured to set the concentration of unburned fuel in the exhaust gas based on unburned fuel discharged from the second cylinders in the rich process.

2. The control device according to claim 1, wherein:

in the rich process, the air-fuel ratio of the air-fuel mixture in the second cylinders is changed to be equal to or less than an upper limit air-fuel ratio and equal to or more than a lower limit air-fuel ratio in accordance with the temperature of the post-processing device; and in the recovery-time process, the air-fuel ratio of the air-fuel mixture in at least one of the plurality of cylinders is set to a specific post-stop air-fuel ratio, the specific post-stop air-fuel ratio being higher than the lower limit air-fuel ratio and lower than the stoichiometric air-fuel ratio.

3. The control device according to claim 2, wherein in the recovery-time process, the air-fuel ratio of the air-fuel mixture in all of the plurality of cylinders is set to the specific post-stop air-fuel ratio.

4. The control device according to claim 1, wherein:

in the rich process, the air-fuel ratio of the air-fuel mixture in the second cylinders is changed to be equal to or less than an upper limit air-fuel ratio and equal to or more than a lower limit air-fuel ratio in accordance with the temperature of the post-processing device;

in the recovery-time process, the air-fuel ratio of the air-fuel mixture in at least one of the plurality of cylinders is set to a specific post-stop air-fuel ratio; and the specific post-stop air-fuel ratio is lower than the upper limit air-fuel ratio.

5. The control device according to claim 4, wherein in the recovery-time process, the air-fuel ratio of the air-fuel mixture in all of the plurality of cylinders is set to the specific post-stop air-fuel ratio.

6. The control device according to claim 1, wherein:

the electronic control unit is further configured to execute a feedback process and a switching process;

in the feedback process, a detected value of an air-fuel sensor provided upstream of the post-processing device is controlled to a target value through feedback control in response to the temperature raising process being not executed;

in the switching process, the target value is caused to transition from one of two values including a feedback rich air-fuel ratio and a feedback lean air-fuel ratio to the other of the two values in response to the temperature raising process being not executed, the feedback rich air-fuel ratio being lower than the stoichiometric air-fuel ratio, and the feedback lean air-fuel ratio being higher than the stoichiometric air-fuel ratio;

in the recovery-time process, the air-fuel ratio of the air-fuel mixture in at least one of the plurality of cylinders is set to a specific post-stop air-fuel ratio; and the specific post-stop air-fuel ratio is lower than the feedback rich air-fuel ratio.

7. The control device according to claim 6, wherein in the recovery-time process, the air-fuel ratio of the air-fuel mixture in all of the plurality of cylinders is set to the specific post-stop air-fuel ratio.

8. The control device according to claim 1, wherein:

the electronic control unit is further configured to execute an all-cylinder fuel cut process;

in the all-cylinder fuel cut process, supply of fuel in all of the plurality of cylinders of the multi-cylinder internal combustion engine is stopped;

in the recovery-time process, the air-fuel ratio of the air-fuel mixture in each of the plurality of cylinders is set to a post-all-stop air-fuel ratio that is lower than a specific post-stop air-fuel ratio after the all-cylinder fuel cut process is stopped; and the specific post-stop air-fuel ratio is the air-fuel ratio of the air-fuel mixture in the plurality of cylinders after the temperature raising process is stopped, the specific post-stop air-fuel ratio being lower than the stoichiometric air-fuel ratio.

9. The control device according to claim 1, wherein:

the electronic control unit is further configured to execute a storage amount calculation process;

in the storage amount calculation process, an oxygen storage amount, which is an amount of oxygen stored in the catalyst, is calculated using, as an input, an intake air amount variable that indicates an amount of air taken into the internal combustion engine;

in the recovery-time process, the air-fuel ratio of the air-fuel mixture in at least one of the plurality of cylinders is set to a specific post-stop air-fuel ratio, and the recovery-time process includes a change process in which the specific post-stop air-fuel ratio is increased stepwise as the oxygen storage amount is decreased.

10. The control device according to claim 9, wherein:

the recovery-time process includes a forced rich process;

in the change process, the specific post-stop air-fuel ratio is changed from a first rich air-fuel ratio to a second rich air-fuel ratio in response to a transition from a first state in which the oxygen storage amount is larger than a prescribed value to a second state in which the oxygen storage amount is equal to or less than the prescribed value;

the first rich air-fuel ratio is lower than the second rich air-fuel ratio; and in the forced rich process, the specific post-stop air-fuel ratio is set to the first rich air-fuel ratio for a predetermined period since the temperature raising process is stopped, even when the oxygen storage amount is equal to or less than the prescribed value.

11. The control device according to claim 1, wherein in the stopping process, the concentration of unburned fuel in the exhaust gas discharged to the exhaust passage is made equal to or lower than the equivalent concentration.

12. A control method for a multi-cylinder internal combustion engine that includes a post-processing device that includes a catalyst having an oxygen storage capability and provided in an exhaust passage, the control method comprising:

executing an injection valve operation process for controlling an air-fuel ratio of an air-fuel mixture in first cylinders and second cylinders of a plurality of cylinders in the internal combustion engine;

executing a temperature raising process of raising a temperature of the post-processing device, the temperature raising process including a stopping process and a rich process, wherein in the stopping process, supply of fuel to the first cylinders of the plurality of cylinders is stopped, and in the rich process, the air-fuel ratio of the air-fuel mixture in the second cylinders of the plurality of cylinders is made lower than a stoichiometric air-fuel ratio, the second cylinders different from the first cylinders; and executing a recovery-time process in which, in response to the temperature raising process being stopped, a concentration of unburned fuel in exhaust gas discharged to the exhaust passage is made higher than an equivalent concentration, the equivalent concentration being a minimum concentration of unburned fuel to react with oxygen in the exhaust gas, wherein the control method further comprises setting the concentration of unburned fuel in the exhaust gas based on unburned fuel discharged from the second cylinders in the rich process.

13. The control method according to claim 12, wherein in the stopping process, the concentration of unburned fuel in the exhaust gas discharged to the exhaust passage is made equal to or lower than the equivalent concentration.

* * * * *